US008574021B2

(12) United States Patent
Mayer et al.

(10) Patent No.: US 8,574,021 B2
(45) Date of Patent: Nov. 5, 2013

(54) FOLDABLE TOY VEHICLES

(75) Inventors: Mark S. Mayer, Los Angeles, CA (US); Allan F. Papp, Redondo Beach, CA (US); William Willett, Irvine, CA (US)

(73) Assignee: Mattel, Inc., El Segundo, CA (US)

( * ) Notice: Subject to any disclaimer, the term of this patent is extended or adjusted under 35 U.S.C. 154(b) by 236 days.

(21) Appl. No.: 13/242,420

(22) Filed: Sep. 23, 2011

(65) Prior Publication Data

US 2013/0078888 A1 Mar. 28, 2013

(51) Int. Cl.
*A63H 17/14* (2006.01)

(52) U.S. Cl.
USPC ..... 446/433

(58) Field of Classification Search
USPC ..... 446/433
See application file for complete search history.

(56) References Cited

U.S. PATENT DOCUMENTS

| | | | |
|---|---|---|---|
| 1,871,297 | A | 8/1932 | Berger |
| 2,018,527 | A | 10/1935 | Kerr |
| 2,070,465 | A | 2/1937 | Ludwig |
| 2,182,913 | A | 12/1939 | Brubaker |
| 2,360,220 | A | 10/1944 | Goldman |
| 2,436,643 | A | 2/1948 | Hatner |
| 2,616,214 | A | 11/1952 | Hydrick |
| 2,778,158 | A | 1/1957 | Ernst |
| 2,832,426 | A | 4/1958 | Seargeant |
| 2,838,875 | A | 6/1958 | Hammond |
| 2,860,715 | A | 11/1958 | Victor |
| 3,447,620 | A | 6/1969 | Schoonover |
| 3,477,339 | A | 11/1969 | Olof |
| 3,574,267 | A | 4/1971 | Schorsch |
| 3,859,752 | A | 1/1975 | Morrison et al. |
| 4,192,093 | A | 3/1980 | Hamano et al. |
| 4,248,006 | A | 2/1981 | Jones et al. |
| 4,363,187 | A | 12/1982 | Shinohara |
| 4,391,060 | A | 7/1983 | Nakane |
| 4,418,495 | A | 12/1983 | Kennedy et al. |
| 4,433,504 | A | 2/1984 | Terui et al. |

(Continued)

FOREIGN PATENT DOCUMENTS

| | | | |
|---|---|---|---|
| EP | 496031 | A1 | 7/1992 |
| EP | 1226855 | A2 | 7/2002 |

(Continued)

OTHER PUBLICATIONS

GB Search Report issued on Jul. 14, 2010 in GB Application No. 1006117.4.

(Continued)

*Primary Examiner* — Michael Dennis
(74) *Attorney, Agent, or Firm* — Panitch Schwarze Belisario & Nadel LLP

(57) ABSTRACT

A toy vehicle reconfigurable between unfolded and folded configurations includes a generally body pivotally supporting a pair of generally planar driving systems on either lateral side. Each driving system includes a motor and gear train driving a continuous track passed over multiple pulley wheels. One pulley wheel of each driving system is carried on an arm mounted to a frame of the system so as to pivot between retracted and extended positions and spring loaded to the extended position. The tracks are sufficiently elastic to accommodate the movement of the one wheel from the extended position to a retracted position. The arms are pushed into the retracted position when the vehicle is pushed into a combined remote control unit and storage case.

11 Claims, 6 Drawing Sheets

(56) References Cited

U.S. PATENT DOCUMENTS

| | | | | |
|---|---|---|---|---|
| 4,457,101 | A | 7/1984 | Matsushiro | |
| 4,458,444 | A | 7/1984 | Avery et al. | |
| 4,466,214 | A | 8/1984 | Kulesza et al. | |
| 4,473,969 | A | 10/1984 | Wilson | |
| 4,483,407 | A * | 11/1984 | Iwamoto et al. | 180/9.5 |
| 4,516,948 | A | 5/1985 | Obara | |
| 4,522,606 | A | 6/1985 | Goldfarb et al. | |
| 4,529,389 | A | 7/1985 | Kennedy et al. | |
| 4,543,073 | A | 9/1985 | Matsuda | |
| 4,556,397 | A | 12/1985 | Arad et al. | |
| 4,571,203 | A | 2/1986 | Murakami | |
| 4,578,046 | A | 3/1986 | Ohno | |
| 4,580,993 | A | 4/1986 | Ohno | |
| 4,586,911 | A | 5/1986 | Murakami | |
| 4,626,223 | A | 12/1986 | Sweet | |
| 4,655,727 | A | 4/1987 | Swisher et al. | |
| 4,666,420 | A | 5/1987 | Nagano | |
| 4,668,205 | A | 5/1987 | Choy et al. | |
| 4,674,990 | A | 6/1987 | Ohno et al. | |
| 4,680,018 | A | 7/1987 | Ohno | |
| 4,690,654 | A | 9/1987 | DeLaney | |
| 4,696,655 | A | 9/1987 | D'Andrade et al. | |
| 4,718,875 | A | 1/1988 | McKittrick et al. | |
| 4,750,895 | A | 6/1988 | Shinohara et al. | |
| 4,822,316 | A | 4/1989 | Shaffer et al. | |
| 4,850,929 | A | 7/1989 | Genevey | |
| 4,892,503 | A | 1/1990 | Kumazawa | |
| 5,135,427 | A | 8/1992 | Suto et al. | |
| 5,167,563 | A | 12/1992 | Saffer | |
| 5,228,880 | A | 7/1993 | Meyer et al. | |
| 5,322,469 | A | 6/1994 | Tilbor | |
| 5,334,075 | A | 8/1994 | Kakizaki et al. | |
| 5,334,076 | A | 8/1994 | Shinozuka | |
| 5,338,246 | A | 8/1994 | Suto | |
| 5,364,300 | A | 11/1994 | Jow | |
| 5,372,534 | A | 12/1994 | Levy et al. | |
| 5,494,304 | A | 2/1996 | Levy et al. | |
| 5,618,219 | A | 4/1997 | Simone et al. | |
| 5,626,506 | A | 5/1997 | Halford et al. | |
| 5,643,041 | A | 7/1997 | Mukaida | |
| 5,667,420 | A | 9/1997 | Menow et al. | |
| 5,868,600 | A | 2/1999 | Watanabe | |
| 5,871,386 | A | 2/1999 | Bart et al. | |
| 5,908,345 | A | 6/1999 | Choi | |
| 5,921,843 | A * | 7/1999 | Skrivan et al. | 446/433 |
| 6,036,574 | A | 3/2000 | Halford | |
| 6,036,575 | A | 3/2000 | Rehkemper et al. | |
| 6,066,026 | A | 5/2000 | Bart et al. | |
| 6,132,287 | A | 10/2000 | Kuralt et al. | |
| 6,322,088 | B1 | 11/2001 | Klamer et al. | |
| 6,350,171 | B1 | 2/2002 | Hippely et al. | |
| 6,383,054 | B1 | 5/2002 | Rauch | |
| 6,394,876 | B1 | 5/2002 | Ishimoto | |
| 6,468,128 | B1 | 10/2002 | Bala et al. | |
| 6,540,583 | B1 | 4/2003 | Hoeting et al. | |
| 6,565,409 | B1 | 5/2003 | Isogai et al. | |
| 6,692,333 | B2 | 2/2004 | Kislevitz et al. | |
| 6,752,684 | B1 | 6/2004 | Lee | |
| 6,764,376 | B2 | 7/2004 | Agostini et al. | |
| 6,767,272 | B2 | 7/2004 | Santarsiero | |
| 6,874,586 | B2 | 4/2005 | Boivin et al. | |
| 6,910,939 | B2 | 6/2005 | Hui | |
| 6,913,507 | B2 | 7/2005 | Hui | |
| 6,926,581 | B2 | 8/2005 | Lynders et al. | |
| 6,957,996 | B2 | 10/2005 | Hui | |
| 6,970,096 | B2 | 11/2005 | Nagata et al. | |
| 7,033,241 | B2 | 4/2006 | Lee et al. | |
| 7,101,250 | B2 | 9/2006 | Lam et al. | |
| 7,184,364 | B2 | 2/2007 | Sawin et al. | |
| 7,217,170 | B2 * | 5/2007 | Moll et al. | 446/164 |
| 7,234,992 | B2 | 6/2007 | Weiss et al. | |
| 7,288,917 | B2 | 10/2007 | Art et al. | |
| 7,387,558 | B2 | 6/2008 | Swisher et al. | |
| 7,393,260 | B2 | 7/2008 | Yamaguchi | |
| 7,410,404 | B2 | 8/2008 | Saeki | |
| 7,466,624 | B2 | 12/2008 | Sawin et al. | |
| 7,503,828 | B2 | 3/2009 | Lee | |
| 7,520,282 | B2 | 4/2009 | Stoltz | |
| 7,563,150 | B2 | 7/2009 | Yamaguchi et al. | |
| 7,568,965 | B2 | 8/2009 | Toriyama et al. | |
| 7,600,592 | B2 * | 10/2009 | Goldenberg et al. | 180/9.1 |
| 7,654,879 | B2 | 2/2010 | Dunham | |
| 7,690,738 | B2 | 4/2010 | Wilt | |
| 2001/0014569 | A1 | 8/2001 | Baker | |
| 2002/0077025 | A1 | 6/2002 | Wu | |
| 2002/0132556 | A1 | 9/2002 | So | |
| 2002/0182974 | A1 | 12/2002 | Grabianski | |
| 2003/0077979 | A1 | 4/2003 | Hoeting et al. | |
| 2003/0104756 | A1 | 6/2003 | Gordon | |
| 2003/0224694 | A1 | 12/2003 | Hoeting et al. | |
| 2006/0135035 | A1 | 6/2006 | Leung | |
| 2006/0183404 | A1 | 8/2006 | Venditti et al. | |
| 2006/0270313 | A1 | 11/2006 | Campbell | |
| 2006/0270314 | A1 | 11/2006 | Campbell et al. | |
| 2006/0270321 | A1 | 11/2006 | Benedict | |
| 2007/0173173 | A1 * | 7/2007 | Suzuki | 446/431 |
| 2007/0259602 | A1 | 11/2007 | Dunham | |
| 2008/0167752 | A1 | 7/2008 | Jacobsen | |
| 2008/0171486 | A1 | 7/2008 | Nagaoka | |
| 2008/0207079 | A1 | 8/2008 | Corsiglia et al. | |
| 2008/0268744 | A1 | 10/2008 | Jones | |
| 2009/0124164 | A1 | 5/2009 | Willett | |
| 2010/0267311 | A1 * | 10/2010 | Zimet | 446/470 |
| 2010/0267331 | A1 | 10/2010 | Ingrassia et al. | |

FOREIGN PATENT DOCUMENTS

| | | | |
|---|---|---|---|
| FR | 2549382 | A1 | 1/1985 |
| GB | 2124094 | A | 2/1984 |
| GB | 2164263 | A | 3/1986 |
| JP | 59156870 | A | 9/1984 |
| JP | 05245270 | A | 9/1993 |
| JP | 2003334390 | A | 11/2003 |
| JP | 2006314440 | A | 11/2006 |
| JP | 2009000442 | A | 1/2009 |
| WO | 2010004459 | A1 | 1/2010 |

OTHER PUBLICATIONS

Five Images of "Flat Ryderz" Play sets and Toy Vehicles, Geospace International, Seattle, Washington, Circa 2006.

* cited by examiner

FOLDABLE TOY VEHICLES

BACKGROUND OF THE INVENTION

The present invention relates generally to foldable vehicles and, more particularly, to vehicles that are selectively reconfigurable between a generally or substantially flat or "folded" configuration for storage or transportation purposes, for example, and an erect or "open" or "unfolded" or "three-dimensional" configuration for movement on or across a ground surface or other operation.

One form of foldable toy vehicle is disclosed in U.S. Pat. No. 6,468,128 (Bala). Bala discloses a collapsible toy car 10 having a front end formed by a front top portion 12 pivotally attached through a hinge 20 to a rear end formed by rear top portion 14. Two "side portions" 16, 18 are each pivotally hinged to the front and rear top portions 12, 14 so as to pivot about an axes generally parallel to the lateral sides. Spaced-apart torsion springs 72 cause the side portions to pivot over an arc of about ninety degrees from the flat configuration (FIG. 2*b*) and an operational or erect configuration (FIG. 3). The Bala toy car is not self-propelled or remotely controlled. Further, the Bala toy car includes an exterior frame (top portion 12, 14 and side portions 16, 18) having a plurality of parts that are all movably attached. As a result, the Bala toy car can be awkward to collapse and configure to return to the erect (i.e. operational) configuration.

U.S. Patent Application Publication No. 2010/0267331, which is incorporated by reference herein in its entirety, discloses a motorized, remotely controlled foldable tracked toy vehicle 20 that includes a body 200, a folding/unfolding assembly or linkage 220, a latching system 252, 254 and two mirror image side portion/suspension members 370*a*, 370*b* that fold up and down ninety degrees on either side of the body/chassis. The side portion/suspension members 370*a*, 370*b* have mirror image driving systems 300*a*, 300*b*, with two separate but identical motors 310. A power supply unit 272*a*, 272*b* and a remote control assembly 276 (FIG. 4D) are located in the body/chassis. A top center "canopy" portion can also be elevated from the remainder of the body/chassis when the side portions are pivoted to their erect positions.

It would be desirable to extend the consumer interest in this type of product by improving upon the design disclosed in U.S. Patent Application Publication No. 2010/0267331.

BRIEF SUMMARY OF THE INVENTION

Briefly stated, the present invention is a foldable toy vehicle comprising: a body having opposing front and rear ends and opposing left and right lateral sides extending between the ends and opposing lower and upper sides extending between the front and rear ends and left and right lateral sides; left and right, generally planar frames elongated front to rear; left and right suspension members extended from the left and right lateral sides of the body respectively connecting the left and right frames with the body so as to pivot each respective frame about an axis extended front to rear between the frame and the body along the respective right and left lateral sides of the body; a linkage further connecting the body with each of the left and right frames so as to simultaneously pivot each of the left and right frames with respect to the body on the respective left and right suspension members with respect to the body between a folded configuration with the left and right frame members generally coplanar and parallel with a generally horizontal plane of the body and an unfolded configuration with the left and right frames generally parallel with one another and perpendicular to the horizontal plane of the body; front and rear track turning members fixedly located on each frame respectively proximal the front and rear of each frame; an endless track on each frame surrounding an entire periphery of the frame and extended over and against at least the front and rear track turning members of the frame for rotation of the track about the frame on the track turning members; at least a third track turning member on each frame supported on a distal end of an arm having a proximal end mounted on the frame for pivotal movement in the plane of the frame about a point located longitudinally between the first and second turning members between a retracted configuration with the distal end located closest to the frame proximal the rear end of the frame and an extended configuration with the distal end located most distant to the frame, the endless track being sized and sufficiently elastic to accommodate the pivotal movement of the arm and third turning member between the retracted and extended configurations without loss of continuous contact with the front, rear and third turning members on the frame; and a bias member on each frame connected between the frame and the arm of the frame so as to bias the arm from the retracted configuration to the extended configuration.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
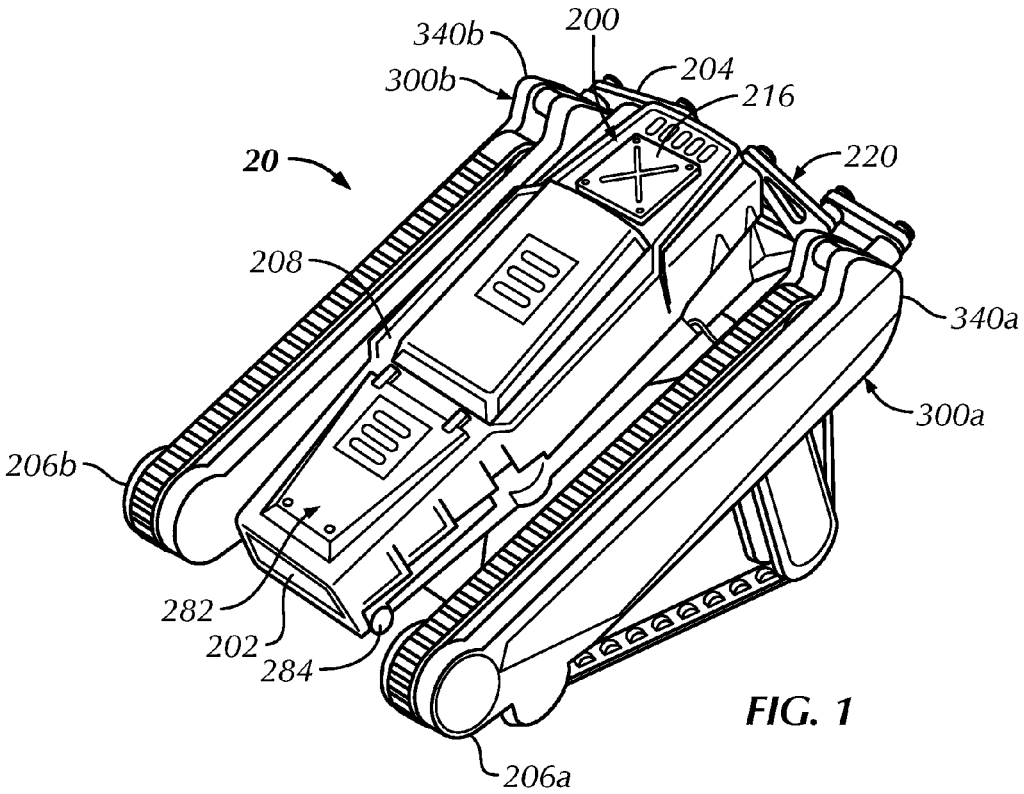
FIG. 1 is a front perspective view of the top and left sides of a preferred embodiment foldable toy vehicle of the present invention in a fully open, unfolded, three-dimensional configuration.

Certain terminology is used in the following description for convenience only and is not limiting. The words "right," "left," "upper," and "lower" designate directions in the drawings to which reference is made. The words "inner," "outer," "inwardly" and "outwardly" refer to directions toward and away from, respectively, the geometric center of the toy vehicle and designated parts thereof. Additionally, the terms "a," "an" and "the," as used in the specification, mean "at least one." The terminology includes the words above specifically mentioned, derivatives thereof, and words of similar import.

Although reference is made specifically to a preferred foldable toy vehicle 20, the invention is not limited to the design shown and described herein, be may be formed in any one of or combination of multiple shapes, designs and colors such as cars, boats, motorcycles, bicycles, trucks, tractors, military-like vehicles, such as tanks, aircraft and airborne vehicles, submarines, marine vehicles, as well as space vehicles, robots, creatures, animals and other kinds of toys.

Referring to the drawings in detail, wherein like numerals indicate like elements throughout, there is shown in the figures a preferred embodiment of a foldable toy vehicle, generally designated 20, in accordance with the present invention, and components thereof. The toy vehicle 20 preferably includes a body 200 having opposing front and rear ends 202, 204, opposing left and right lateral sides 206*a*, 206*b* extending between the front and rear ends, an upper side 208 and an opposing lower side 210 extending between the front and rear ends 202, 204 generally between the left and right lateral sides 206*a*, 206*b*. The toy vehicle 20 further includes a pair of preferably mirror image, generally planar left and right driving systems 300*a*, 300*b* including left and right, generally planar frames 340*a*, 340*b* elongated front to rear on either lateral side of the body 200.

Figure 4:
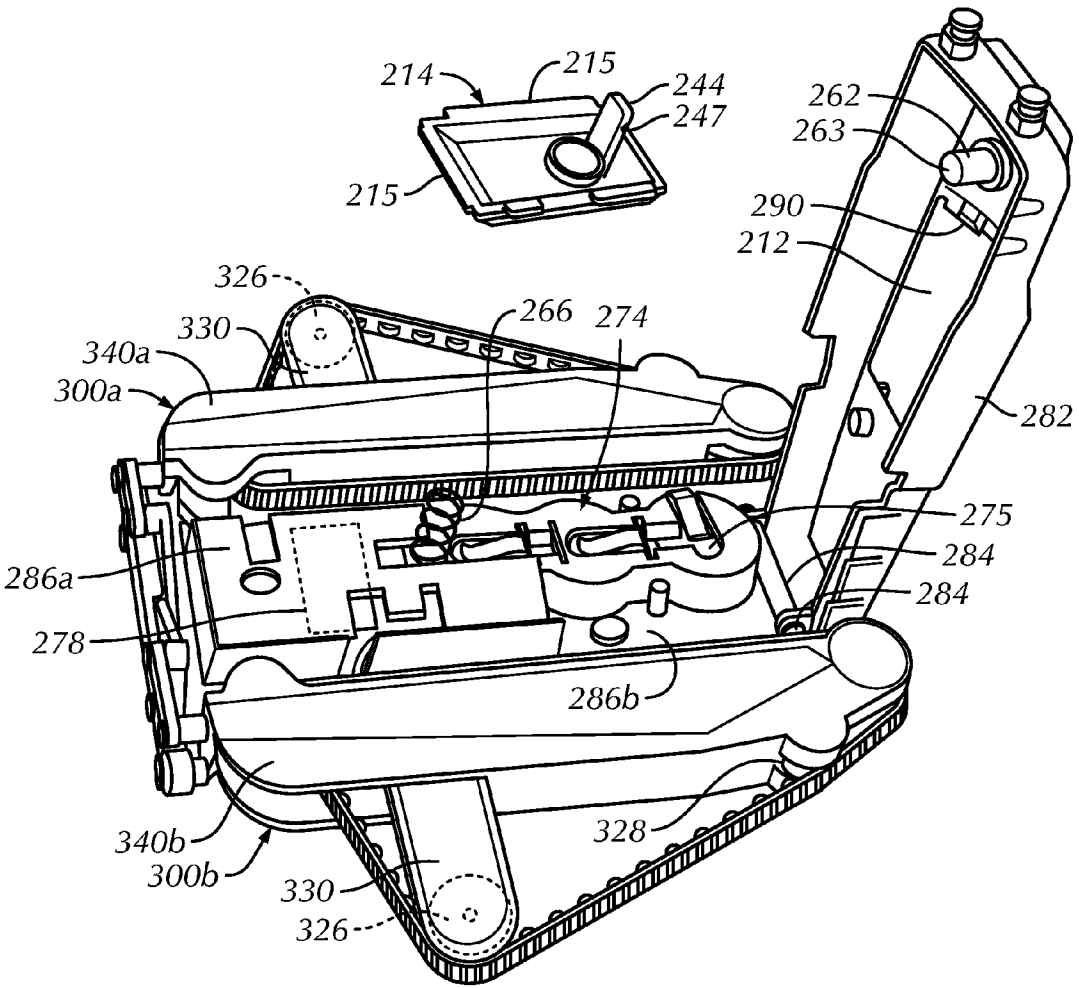
FIG. 4 is a rear perspective view of the toy vehicle shown in the folded configuration of FIG. 3 with the upper part of the vehicle body pivoted away from the lower part of the vehicle body.
Figure 5:
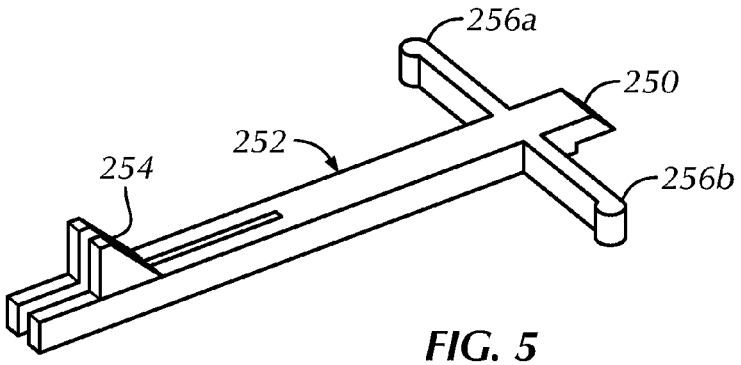
FIG. 5 is a top perspective view of a latch member within the lower body part.

The body 200 preferably includes a lower part 280 and an upper part 282 movable with respect to the lower part 280, preferably by being pivotally connected to the lower part 280 preferably at one end and, more preferably, the front end of the body 200, via a hinge indicated at 284 with hinge pin 284*a* (FIG. 4). The lower part 280 preferably is a conventional chassis that itself is formed by joined, opposing upper and lower chassis shells 286*a*, 286*b* with the lower chassis shell 286*b* essentially forming the lower side 210 of the body 200. The shells contain an on-board power supply 274 formed by a plurality of individual button batteries 275, and an electronic circuit assembly 278 (in phantom) including a wireless signal receiver and a microprocessor or application specific integrated circuit controller connected to the receiver and to motors in the driving systems 300 to maneuver the toy vehicle 20. Wireless remote control may be implemented utilizing any known, conventional wireless remote control communication technology using radio, light or sound. The upper part 282 preferably includes a hinged upper body member 288 (see FIG. 6) that forms at least a major portion of the upper side 208 and a roof member 214 that is movably captured within a large rectangular opening 212 provided in the upper body member 288. At least one linear compression bias member 266 is mounted within the body 220 between the upper and lower sides 208, 210 and between upper and lower parts 282, 280 of the body 200 so as to bias and pivot the upper part 282 away from the lower part 280. Preferably, the linear compression bias member 266 is a compression coil spring (also 266). More than one linear compression bias member/coil spring may be provided. As another alternative, the compression coil spring(s) 266 might be replaced by one or more other types of linear compression bias members, for example a leaf spring or even a block of compressible foam material, positioned so as to bias the upper part 282 of the body 200 upward and away from the lower part 280 of the body 200 and to actuate a linkage 220 as will be described. In the preferred embodiment, the linear compression bias member/spring 266 is preferably located between the upper shell 286*a* of the lower part 280 and the roof member 214 of the upper part 282.

Figure 8:
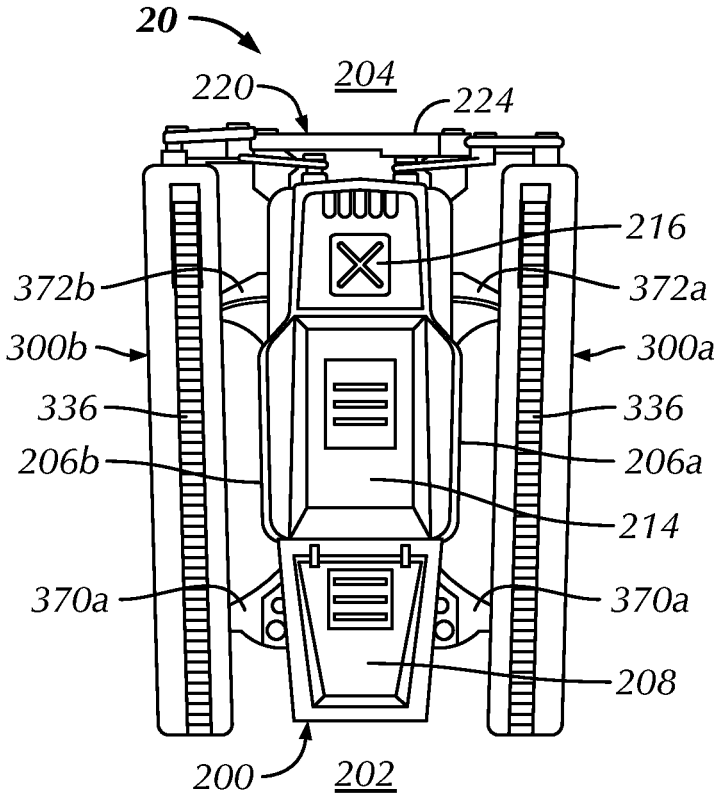
FIG. 8 is a top plan view of the erect toy vehicle of FIGS. 1 and 2.

Driving systems 300*a*, 300*b* are pivotally mounted through their frames 340*a*, 340*b* to the opposing lateral sides 206*a*, 206*b*, respectively of the body 200 on left suspension members 370*a*, 372*a* and right suspension members 370*b*, 372*b*. As best seen in FIG. 8, left suspension members 370*a*, 372*a* and right suspension members 370*b*, 372*b* are extended outwardly from the left and right lateral sides 206*a*, 206*b* of the body 200 proximal the front and rear ends 202, 204, respectively, of the body 200. The suspension members 370*a*, 372*a*, 370*b*, 372*b* are preferably integral portions of the lower part 280 of the body 200, respectively. The suspension members 370*a*, 372*a*, 370*b*, 372*b* operably connect the left and right frames 340*a*, 340*b*, respectively, with the body 200 so as to pivot each respective frame about an axis extended front to rear between the respective frame and the suspension member (s) along the respective left and right lateral sides 206*a*, 206*b* of the body 200. They also support wires to the motors in the driving systems.

A folding/unfolding assembly in the form of the previously mentioned linkage 220 is provided at the rear end 204 of the vehicle 20. The linkage 220 is operably engaged with the rear end 204 of the body 200 through each of the lower and upper parts 280, 282 of the body as well as with the rear end of each frame 340*a*, 340*b* of each driving system 300*a*, 300*b*, respectively. The linkage 220 is configured to be actuated to pivot the frames 340*a*, 340*b* by the pivotal movement of the upper part 282 away from the lower part 280. The linkage 220 simultaneously pivots each frame 340*a*, 340*b* and driving system 300*a*, 300*b* with respect to the body 200 on the respective left and right suspension members 370*a*/372*a*, 370*b*/372*b* between the folded configuration seen in FIGS. 3 and 10 with the left and right driving systems 300*a*, 300*b* and frames 340*a*, 340*b* substantially coplanar and parallel with each other and a generally horizontal plane of the body, and the unfolded configuration seen in FIGS. 1, 2 and 8 with the left and right driving systems 300*a*, 300*b* and frames 340*a*, 340*b* generally parallel with one another and perpendicular to the horizontal plane of the body 200 and to the plane of the surface supporting the toy vehicle 20 (i.e. plane of FIG. 8).

Figure 2:
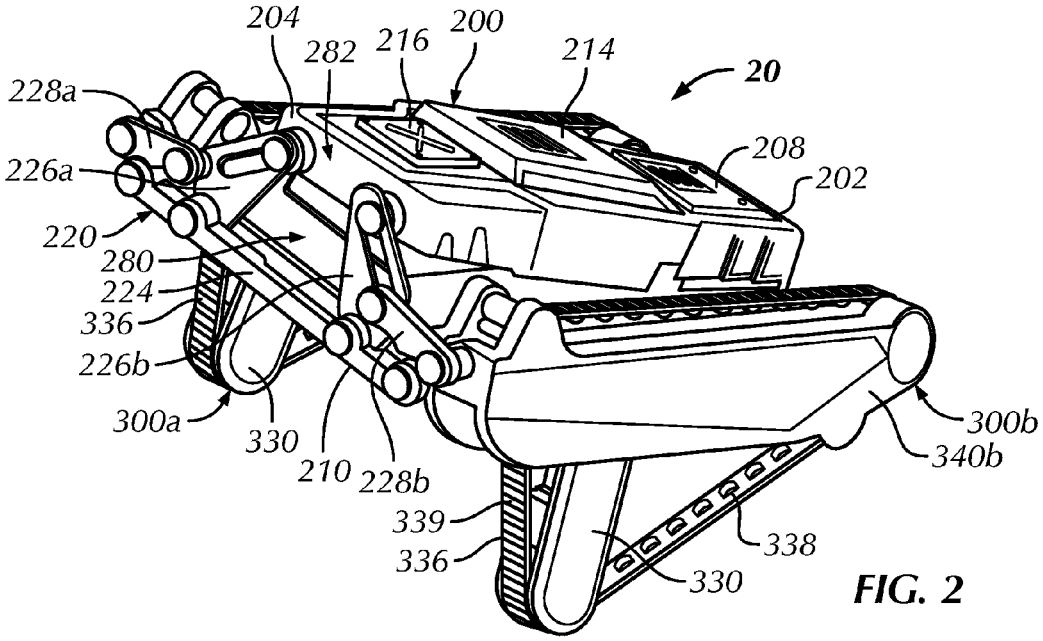
FIG. 2 is a rear perspective view of the top and right sides of the toy vehicle shown in FIG. 1.
Figure 3:
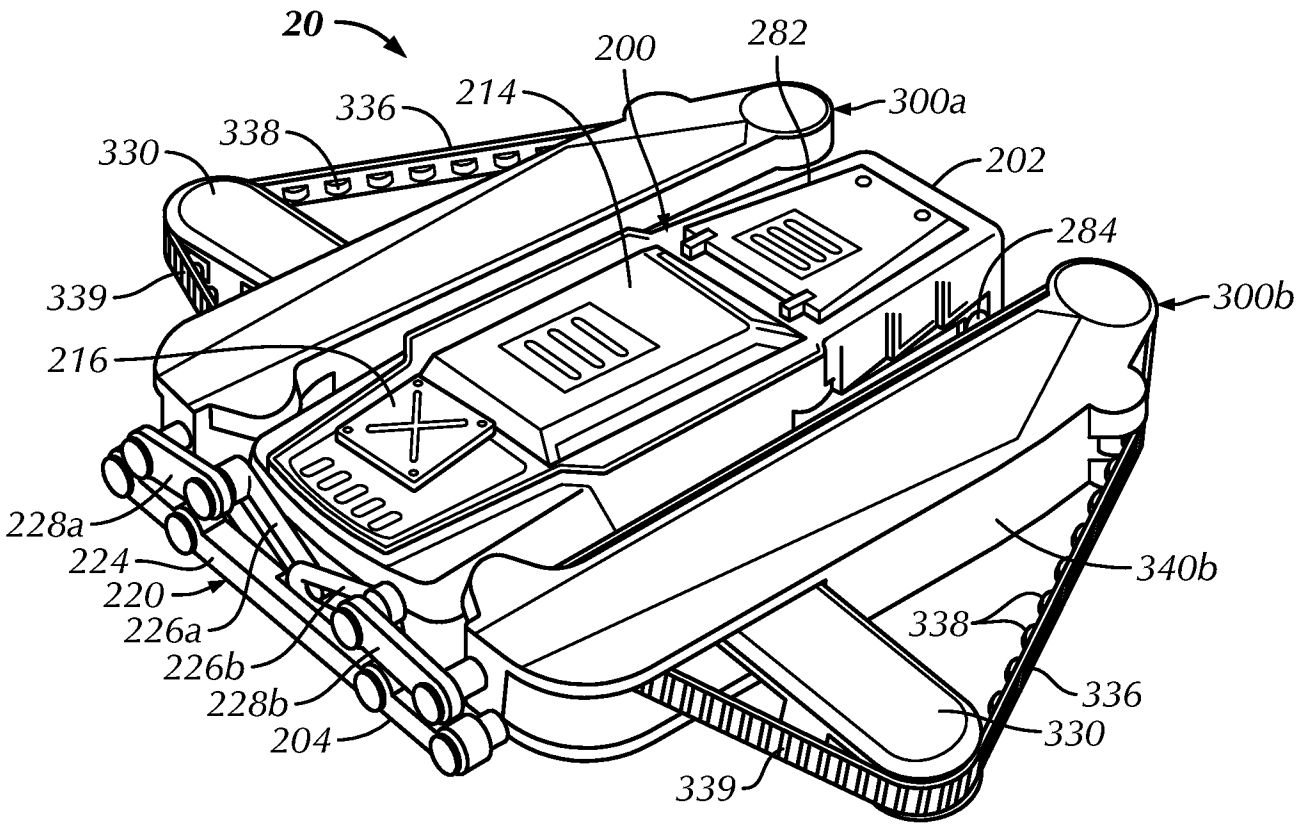
FIG. 3 is a rear perspective view of the top and right sides of the toy vehicle shown in FIGS. 1 and 2 in a folded configuration in accordance with the present invention.

Referring to FIGS. 2 and 3, the preferred linkage 220 more particularly includes a pair of triangular bell cranks 226*a*, 226*b* each pivotally coupled at a lower end with the lower part 280 of the body 200, at an upper end with the upper part 282 of the body 200, and at an outer end with proximal ends of a pair of side links 228*a*, 228*b*. The side links 228*a*, 228*b* each have the one end pivotally coupled with a separate one of the bell cranks 226*a*, 226*b*, respectively, and an opposing end pivotally coupled with a separate one of the right and left frames 340*a*, 340*b*, respectively. A horizontal bar 224 is fixed with the lower part 280 of the housing 200 and is pivotally coupled with each frame 340*a*, 340*b* along the pivot axis of that frame extending through the respective suspension members 270*a*/272*a*. 270*b*/272*b*.

The upper body member 288 of the body 200 preferably movably retains the vehicle roof member 214 in rectangular opening 212 to latch the vehicle 20 in the collapsed condition as will be described. One or more flanges 215 protrude outwardly from one or more sides of the lower outer perimeter of the roof member 214 and are positioned and sized so as to overlap and engage the upper body member 288 around the inside perimeter of the opening 212. A recessed lip 290 is preferably provided at the rear end of the opening 212 to catch the rear end of the roof member 214 and prevent the rear end from being depressed into the upper body member 288. At least one bias member, preferably the one compression coil spring 266, is positioned within the body 200 so as to bias the roof member 214 up against the inner side of the upper member 282. The body 200 further supports a push button 216 to the rear of the roof member 214, which is also mounted in the upper part 282 for vertical movement.

Figure 6:
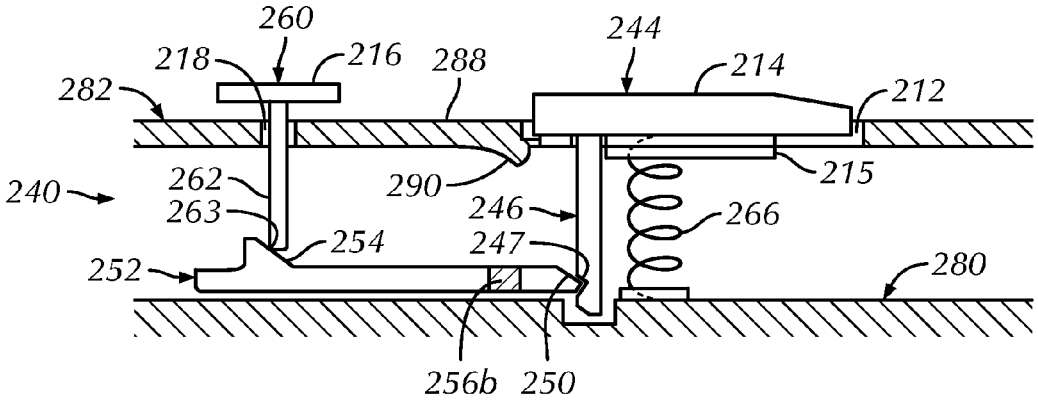
FIG. 6 is a schematic side elevation of the components of the latch mechanism.
Figure 9:
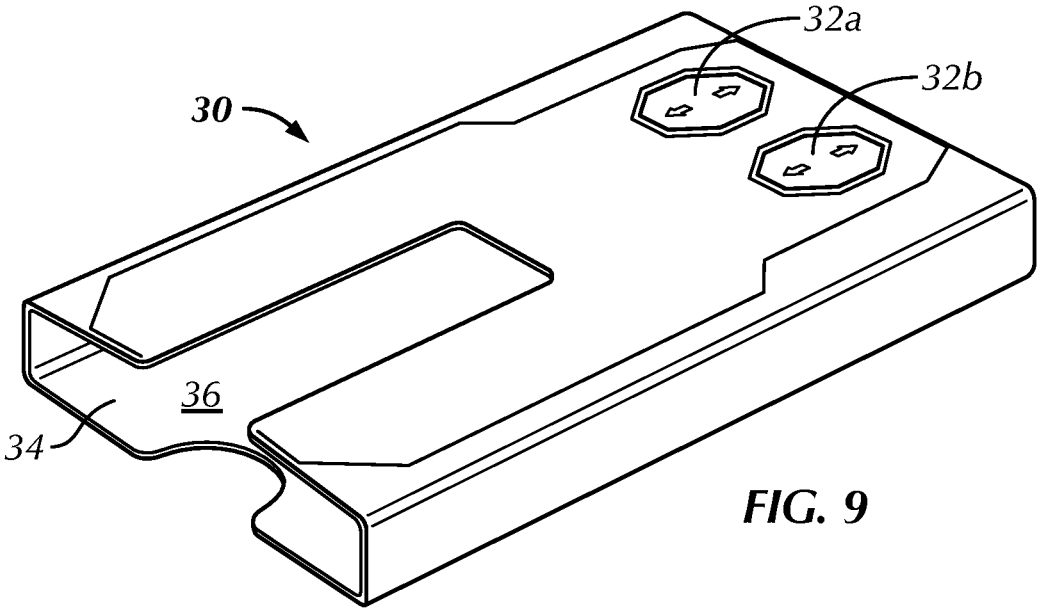
FIG. 9 is a perspective view of a combination remote control unit/storage case.

The roof member 214 and push button 216 are parts of a latch mechanism indicated generally at 240 in FIG. 6. The latch mechanism 240 maintains the generally flat orientation of the collapsed configuration of the toy vehicle 20 depicted in FIGS. 3 and 9 and allows unfolding of the toy vehicle 20 when released. The latch mechanism 240 includes a latch slidably supported by one of the upper part 282 and the lower part 280 of the body 200, a latch holder positioned on a remaining one of the upper part and the lower part of the body to be engaged by the latch and a release actuator exposed on the body 200 for manual movement and operably connected with the latch so as to slide the latch from engagement with the latch holder upon manual movement of the actuator. More particularly, a latch holder 244 is preferably movably supported on the upper part 282 and includes the roof member 214 and a post 246 extending downward from the roof member 214. Post 246 has a lowermost distal end shaped as a latch keeper by the provision of a latch receiving recess 247. A latch member 252 is shown in FIG. 6 and has a latch 250 integrally formed at one distal end configured so as to engage with the recess 247 of the latch holder 244 when vertically aligned with the recess 247. Latch member 252 is mounted on the lower body part 280 between the upper and lower chassis shells 286*a*, 286*b* to slide forward and backward. Latch member 252 preferably also integrally includes a sloped cam face 254 on an upper side thereof and a pair of flexibly resilient bias members 256*a*, 256*b* extending outwardly from opposing lateral sides of the member 252. Cam face 254 is oriented forward towards the latch 250. Bias members 256*a*, 256*b* are located within the body 200 between chassis shells 286*a*, 286*b* of the lower part 280 and are preferably operably engaged with portions of the chassis shells 286*a*, 286*b* to maintain the latch member 252 and sliding latch 250 in a nominally forward most position where it is located to engage the recess 247 with the recess 247 in vertical alignment with the latch 250.

Latch mechanism 240 further includes a manually operated latch release 260. Latch release 260 includes push button 216 and a post 262 extending downward from the button 216 through and preferably keyed with respect to a second opening 218 though the upper body member 288 of the upper part 282. The lowermost distal end 263 of the post 262 is positioned over and preferably rests against an upper end of the cam face 254 so that, when the button 216 is depressed, the distal end 263 of the post 262 bears down on the cam face 254 and pushes the sliding latch 250 and latch member 252 rearward (left in FIG. 6), away from the latch holder 244, thereby disengaging the latch 250 from the holder recess 247.

The toy vehicle 20 is thus adapted to convert from the three-dimensional erect configuration of FIGS. 1 and 2 to the substantially flat, folded configuration of FIG. 3 by squeezing the body 200. In the preferred embodiment, because of the location of the recess 247, the permitted movement of the roof member 214 with respect to the upper body member 288 and the bias of the compression coil spring 266, unless the roof member 214 is fully depressed, the recess 247 will not align with the sliding latch 250. Consequently, in order to latch the preferred toy vehicle 20 in the flattened configuration of FIG. 3, it is necessary to fully depress the roof member 214 into the upper body member 288 and against the lower part 280. This is accomplished by squeezing together the roof member 214 and the lower part 280. The indicated mounting of the roof member 214 in the opening 212 in the upper body member 286 further forces the linkage to full collapse against the bias of spring 266 and allows the roof member 214 to be retained in a most depressed position with respect to the lower part 280 and the latch holder 244 engaged with the latch 250.

It should be appreciated that the latch holder 244 can be immovably fixed in or with the remainder of the upper body member 288, for example by forming the upper part 282 with the roof member 214 and upper body member 288 together in one piece, in which case the toy vehicle would be latched in the flattened condition by squeezing together the upper and lower parts 282, 280. It will be further be appreciated that in such modification, the upper part 282 can be molded from a resiliently flexible plastic or metal and the recess 247 located along the post 246 at a height such that the upper part 282 needs to be deflected slightly inward to align with and engage the sliding latch 250 for a more positive latching. It will further be appreciated that the bias members 256*a*, 256*b* may be replaced by one or more individual bias members not integral with the latch 250 and cam face 254.

Figure 7:
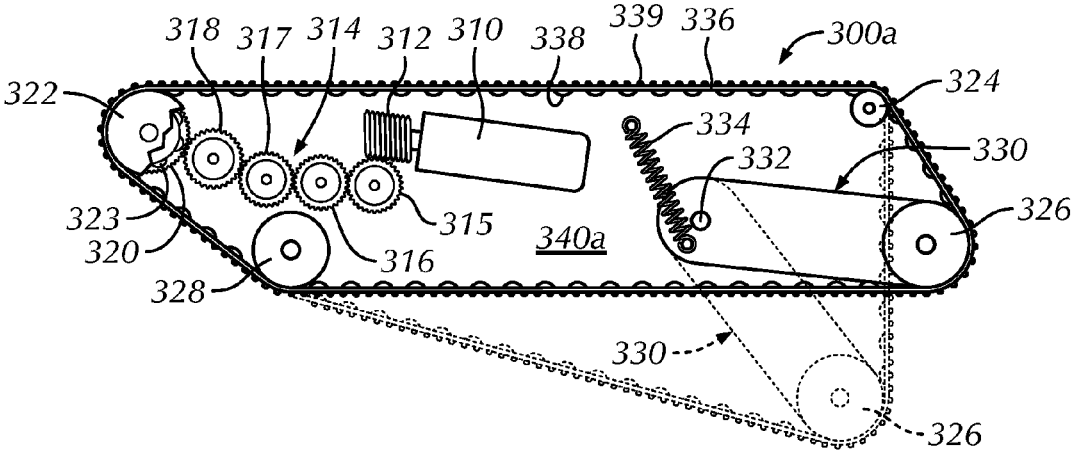
FIG. 7 is a partially broken away side elevation of one of the driving systems of the toy vehicle.

Each driving system 300*a*, 300*b* is a mirror image of the other so the following description applies to each. Referring to FIG. 7, in the preferred embodiment, each driving system 300*a*, 300*b* includes at least one electrical motor 310 rotating a worm 312 and a gear train 314 that includes a worm gear 315 and a plurality of idler gears 316-318 engaged with a final driven output gear 320. A first or front track turning member 322 is provided in the form of a first or driving pulley wheel, also sometimes referred to simply as "wheel 322", that is fixed to and coaxial with the final gear 320 of the gear train 314 to rotate with the final gear of the gear train on the frame 340 proximal the upper side of its front end. The driving pulley wheel may be located at the rear end or anywhere along the outer periphery of the frame 340. Another pulley wheel 324 is fixedly located on the frame 340 to rotate proximal the rear end of the frame 340 and constitutes a second or rear track turning member also 324. A third pulley wheel 326 is located beneath the second pulley wheel and constitutes a third track turning member, also 326, at the rear end of the frame 340 while a fourth pulley wheel 328 is fixed to the frame 340 beneath the first driving pulley wheel 322 near the front end of the frame and constitutes a fourth track turning member, also 328. The second and fourth pulley wheels/track turning members 324, 328 are fixedly mounted to the frame 340 for free rotation respectively proximal the rear and front ends of the frame 340. The third pulley wheel/track turning member 326 is rotatably supported on a distal end of an arm 330 having a proximal end mounted on the frame 340 for pivotal movement in the plane of the frame 340 about a pivot point 332 formed by a pin, also 332, located below and longitudinally between the first and second turning members 322 and 324. The arm 330 is pivotable between a retracted configuration shown in solid in FIG. 7, with the distal end located closest to the frame 340 proximal the rear end of the frame, and an extended configuration indicated in phantom in FIG. 7, with the distal end located most distant to the frame 340. Preferably the arm 330 on each frame 340 is biased outward/downward by the provision of a bias member 334 on each frame. Preferably bias member 334 is in the form of a tensile coil spring, also 334, connected between the frame 340 and the arm 330 so as to bias the arm 330 from the retracted configuration to the extended configuration.

Each driving system 300*a*, 300*b* includes a flexible endless track 336 on each frame 340 unbrokenly continuously surrounding an entire outer periphery of the frame 340 and extended over and against at least the track turning members 322, 324, 326 and 328 of the frame 340 for rotation of the track 336 about the frame 340 on the track turning members 322, 324, 326 and 328 to maneuver the toy vehicle 20. The endless track 336 is sized and sufficiently elastic to accommodate the pivotal movement of the arm 330 and third turning member 326 between the retracted and extended configurations without loss of continuous contact with the four track turning members 322, 324, 326, 328. Preferably at least the first or driving turning member/pulley wheel 322 is also toothed and the endless track 336 includes inward facing lugs 338 matingly configured to mesh with teeth 323 of the toothed pulley wheel 322 for more positive engagement. Outward facing lugs 339 may be provided on the elastic endless track 336 to improve vehicle traction on rough or shifting support surfaces. The inward facing lugs 338 are preferably curvilinear, for example semi-elliptical as shown, so as to slip over the teeth 323 of the toothed pulley wheel 322 were the track to grabbed. Alternatively or in addition, the driven gear 320 could be clutched with the toothed pulley wheel 322. Other alternative arrangements are possible as well.

In the preferred embodiment, the toy vehicle 20 in the folded or flat configuration has a card-like size and shape with a thickness suggestively in a range of five to fifteen millimeters, such that the toy vehicle 20 can be carried in a pants pocket, for example. The toy vehicle 20 can be made of various materials such as plastic, metal and any other rigid material suitable for the purpose of the present invention. Alternatively, in the folded or flat configuration the toy vehicle 20 may have a larger dimensions ratio of thickness to length, or width. For example, such ratio may be in the range of one to between four and ten.

Figure 10:
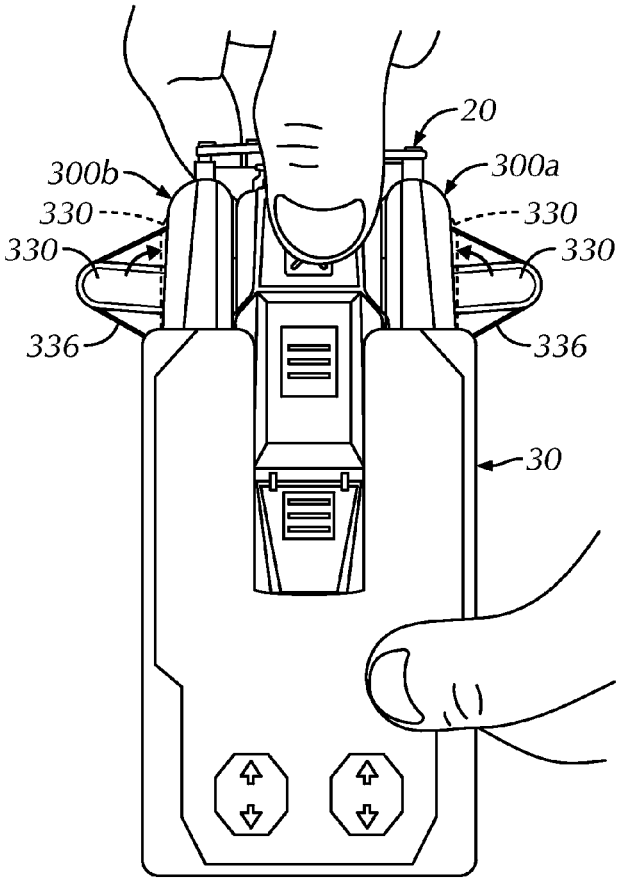
FIG. 10 is a top plan view of the collapsed toy vehicle of FIG. 3 being inserted into its case.
Figure 11:
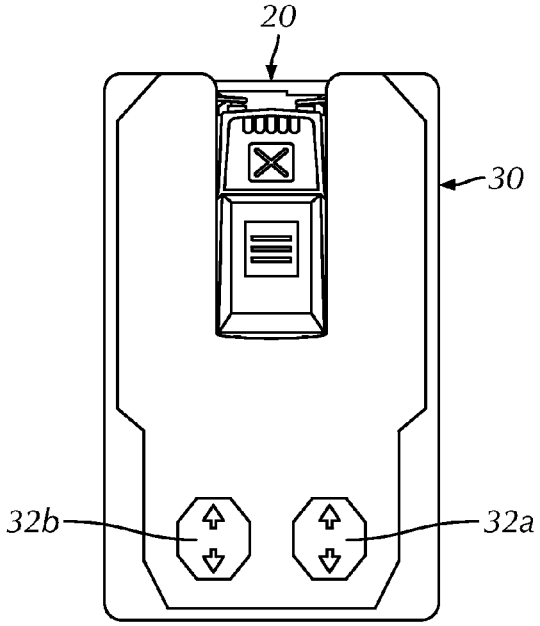
FIG. 11 is a top plan view of the case showing the fully inserted toy vehicle.

As seen in FIGS. 10-11, the toy vehicle 20 in the flat configuration may also be stored within a case 30. Case 30 has a preferably rectangular opening 34 at its rear end to provide access to a cavity or hollow interior 36 of the case 30 with dimensions about the height and width of the flattened toy vehicle across its body 200 and driving system frames 340*a*, 340*b*. As can be seen in FIG. 10, the arms 330 and their supported third track turning device/pulley wheels 326 extend beyond the side edges of the opening 34. As the arms 330 are pivotable rearward from their extended to their retracted configuration, the arms 330 can be pivoted from their extended configuration to their retracted configuration (in phantom) simply by inserting the front end 202 of the vehicle 20 into the opening 34 and sliding the remainder of the vehicle 20 into the hollow interior 36. The arms 330 will be pivoted rearward by the side walls of the case 30 at the opening 34 as the arms 330 are pressed against those walls.

Preferably, the case 30 is further configured to function as a wireless remote control device to permit user control of the toy vehicle 20 in the unfolded or three-dimensional erect configuration. To that end, the case is provided with user input buttons 32*a*, 32*b*. In addition, the case 30 is internally provided with at least one wireless signal transmitter, circuitry to convert user inputs from actuation of the buttons 32*a*, 32*b* into control signals for wireless transmission, and a power supply. For example, each button 32*a*, 32*b* may control forward and reverse operation of the motor 310 in a respective one of the driving systems 300*a*, 300*b*, respectively. Preferably each button 32*a*, 32*b* also controls its own wireless signal transmitter, and is further configured to operate at two different frequencies.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A foldable toy vehicle (20) comprising:

a body having opposing front and rear ends and opposing left and right lateral sides extending between the ends and opposing lower and upper sides extending between the front and rear ends and left and right lateral sides left and right, generally planar frames elongated front to rear;

left and right suspension members extended from the left and right lateral sides of the body respectively connecting the left and right frames with the body so as to pivot each respective frame about an axis extended front to rear between the frame and the body along the respective right and left lateral sides of the body;

a linkage further connecting the body with each of the left and right frames so as to simultaneously pivot each of the left and right frames with respect to the body on the respective left and right suspension members with respect to the body between a folded configuration with the left and right frame members generally coplanar and parallel with a generally horizontal plane of the body and an unfolded configuration with the left and right frames generally parallel with one another and perpendicular to the horizontal plane of the body;

front and rear track turning members fixedly located on each frame respectively proximal the front and rear of each frame;

an endless track on each frame surrounding an entire periphery of the frame and extended over and against at least the front and rear track turning members of the frame for rotation of the track about the frame on the track turning members;

at least a third track turning member on each frame supported on a distal end of an arm having a proximal end mounted on the frame for pivotal movement in the plane of the frame about a point located longitudinally between the first and second turning members between a retracted configuration with the distal end located closest to the frame proximal the rear end of the frame and an extended configuration with the distal end located most distant to the frame, the endless track being sized and sufficiently elastic to accommodate the pivotal movement of the arm and third turning member between the retracted and extended configurations without loss of continuous contact with the front, rear and third turning members on the frame; and a bias member on each frame connected between the frame and the arm of the frame so as to bias the arm from the retracted configuration to the extended configuration.

2. The toy vehicle of claim 1 further comprising on each frame:

a motor, a worm, and a gear train operably connected together and with at least one track turning member on the frame such that operation of the motor rotates the worm to drive the gear train to rotate the at least one track turning member to drive the flexible track and propel the toy vehicle.

3. The toy vehicle according to claim 2 wherein the at least one track turning member of each frame is a toothed pulley wheel fixed to and coaxial with a final gear of the gear train to rotate with the final gear of the gear train and wherein the endless track on each frame includes inward facing lugs meshing with teeth of the toothed pulley wheel.

4. The toy vehicle according to claim 1 wherein the body includes a lower part essentially forming the lower side of the body and an upper part forming at least a major portion of the upper side of the body and pivotally connected to the lower part; and further comprising at least one linear compression bias member mounted between the upper and lower parts of the body so as to pivot the upper part of the body away from the lower part of the body.

5. The toy vehicle according to claim 1 wherein the linear compression bias member is a compression coil spring.

6. The toy vehicle according to claim 4 wherein the linkage is configured to be actuated to pivot the frames by the pivotal movement of the upper part away from the lower part.

7. The toy vehicle according to claim 4 further comprising a latch slidably supported by one of the upper part and the lower part of the body, a latch holder positioned on a remaining one of the upper part and the lower part of the body to be engaged by the latch and an actuator exposed on the body for manual movement and operably connected with the latch so as to slide the latch from engagement with the latch holder upon manual movement of the actuator, and a linear compression member located between the upper part and the lower part so as to pivot the upper part away from the lower part with release of the latch from the latch holder.

8. The toy vehicle according to claim 7 wherein the folded configuration of the toy vehicle is achieved by moving the upper part of the body toward the lower part of the body against the bias of the linear compression bias member until the latch holder engages the sliding latch.

9. The toy vehicle according to claim 1 wherein in the retracted configuration, the third turning member is located proximal the rear of the frame; and further comprising a fourth track turning member fixedly located on each frame proximal the front of each frame in continuous engagement with the endless track.

10. The toy vehicle according to claim 1 wherein the linkage includes a pair of bell cranks each pivotally coupled at a lower end with the lower part of the body, at an upper end with the upper part of the body, and at an outer end with a proximal end of a separate one of a pair of side links, the side links each having the one end pivotally coupled with a separate one of the turn cranks, respectively, and an opposing end pivotally coupled with a separate one of the right and left frames, respectively, and a horizontal bar fixed with the lower part of the body and pivotally coupled with each frame along the pivot axis of the respective frame.

11. The toy vehicle according to claim 1 wherein in the folded configuration, the toy vehicle is sized and shaped to fit within a hollow interior of a shell, the hollow interior having a rectangular open end receiving the folded toy vehicle, and wherein the shell is also a remote control unit to operate the toy vehicle in the unfolded configuration.

* * * * *